United States Patent [19]

Green et al.

[11] Patent Number: 4,572,084

[45] Date of Patent: Feb. 25, 1986

[54] METHOD AND APPARATUS OF GAS-COAL COMBUSTION IN STEAM BOILERS

[75] Inventors: Alex E. S. Green, Gainesville; Bruce A. S. Green, Micanopy, both of Fla.

[73] Assignee: University of Florida, Gainesville, Fla.

[21] Appl. No.: 500,394

[22] Filed: Jun. 2, 1983

Related U.S. Application Data

[63] Continuation of Ser. No. 306,177, Sep. 28, 1981, abandoned.

[51] Int. Cl.[4] ..... F23C 1/10

[52] U.S. Cl. ..... 110/261; 110/264; 110/265; 110/266; 110/347; 431/4; 431/9; 431/173; 431/137; 431/284

[58] Field of Search ..... 110/260, 261, 262, 263, 110/264, 265, 266, 347; 431/4, 9, 182, 185, 187, 173, 284; 239/400, 406, 478, 479

[56] References Cited

U.S. PATENT DOCUMENTS

| | | | |
|---|---|---|---|
| 2,755,750 | 7/1956 | Escher | 110/264 |
| 3,302,596 | 2/1967 | Zinn | 431/284 |
| 3,393,650 | 7/1968 | Daman et al. | 110/261 |
| 3,746,498 | 7/1973 | Stengel | 431/4 |
| 4,060,041 | 11/1977 | Sowards | 110/264 |
| 4,094,625 | 6/1978 | Wang et al. | 431/284 |
| 4,147,116 | 4/1979 | Graybill | 110/347 |
| 4,208,180 | 6/1980 | Nakayasu et al. | 431/284 |
| 4,357,134 | 11/1982 | Katsushige et al. | 431/9 |
| 4,407,205 | 10/1983 | Beaufrere | 110/264 |
| 4,412,810 | 11/1983 | Izuha et al. | 431/187 |

FOREIGN PATENT DOCUMENTS

| | | | |
|---|---|---|---|
| 159741 | 12/1979 | Japan | 110/264 |

*Primary Examiner*—Edward G. Favors
*Assistant Examiner*—Steven E. Warner
*Attorney, Agent, or Firm*—Arthur G. Yeager

[57] ABSTRACT

Various embodiments of apparatus and methods are disclosed for the conversion of steam boilers from being oil fired to coal and natural gas fired without adversely affecting the normal power density of the boilers or the emission pollution therefrom. In some cases even the resultant coal ash can be modified by injecting a powdered catalyst or phosphate slimes into the flame to produce a fertilizer ash having desirable minerals to enhance the economic value thereof.

Basically all embodiments include a swirling coal-air mixture directed along a path to form a sheath and a swirling gas-air mixture internally thereof with the swirling of the latter being in the same direction and fortifying the motion of the former. A gas-air mixture, swirling or non-swirling, may be supplied outwardly of such sheath to enhance the more complete burning of the coal-air mixture.

41 Claims, 7 Drawing Figures

METHOD AND APPARATUS OF GAS-COAL COMBUSTION IN STEAM BOILERS

This application is a continuation of application Ser. No. 306,177 filed Sept. 28, 1981 now abandoned.

BACKGROUND OF THE INVENTION

This invention relates to methods and apparatus for using coal and natural gas to displace residual oil in existing steam boilers. The methods take advantage of the desirable characteristics of natural gas (including low pollution and high power density) to counteract or neutralize the repulsive characteristics of coal (including high pollution and low power density) to achieve the generally acceptable characteristics of residual oil (middle level of pollution and middle power density) as well as providing improved results as hereinafter more fully described.

The specific characteristics and constructional details of the gas-coal burning apparatus will require various embodiments depending upon the detailed characteristics of the coal used, and the specific oil boiler to be retrofitted. However, three broad classes of gas-coal (oil displaced) burners may be identified as follows:

Type 1 burners, to utilize coal with low sulfur content and low ash content, with high fusion temperature.

Type 2 burners, to utilize coal with low to moderate sulfur content and high ash content, with high fusion temperature.

Type 3 burners, to utilize coal with lower to moderate sulfur and high ash content, with low fusion temperature.

Before describing specific characteristics of each of these types, the general principles and underlying problems in using gas and coal to displace oil will be considered.

Coal, a solid, is an undesirable and even a repulsive fuel. The technology of coal burning is very complex, requiring elaborate facilities for transportation and storage, for grinding and pulverizing, and delivery to the burner, for environmental control of bottom ash, fly ash and other suspended particulates, and for $SO_x$ and $NO_x$ suppression. For the United States and in some other countries, coal has one very important and redeeming feature, namely the abundance thereof.

Oil, a liquid hydrocarbon, is a more acceptable and neutral fuel. Handling and storage problems are somewhat simpler than coal. However, the predominant grade of oil used in steam boilers, No. 6 or residual oil, also has associated $SO_x$ and $NO_x$, ash and heavy metal problems. More importantly, however, is the fact that the United States can barely produce sufficient oil to satisfy its needs for transportation, where the liquid form is more essential at this time. The problems are even more compounded in other countries where no oil is produced. The use of oil by utilities and industry must be viewed as a major cause of our excessive dependence upon imported oil, and the associated severe economic problems the United States and most of the world are now facing.

Natural gas, a gaseous fuel consisting primarily of methane ($CH_4$), is a highly attractive fuel. Transportation by pipeline and handling are very simple and local storage is not required, if an adequate pipeline is provided. The burning system for natural gas is simple and there are no ash and $SO_x$ problems. Unfortunately, there are regulatory problems associated with natural gas which stem from pre 1978 estimates of natural gas reserves which suggested that United States production would decline from 20 TCF (Trillion Cubic Feet) to about 10 TCF by the year 2000. Based upon such an assumption, the Public Utility and Industrial Fuel Use Act (PIFUA) of 1978 was enacted to phase out the industrial and public utilities use of oil and natural gas. However, recent drillers, while supporting declining oil reserve projections, have not supported declining natural gas projections. Rather conservative projections now favor a continuous annual production capability to the year 2000 at about 20 TCF, and optimistic projections suggest 30 TCF might be achieved. In the present analysis the middle of the road projection will be used, namely that natural gas can provide approximately 25% of the energy needs of the United States through the year 2000 AD.

Granting the abundant availability of coal, a fuel with repulsive characteristics (high pollution, lower power density) the moderate availability of natural gas, with attractive characteristics (low pollution, high power density) a novel solution emerges to the serious problems posed by the shortage of oil in the United States, namely a fuel with neutral characteristics (accepted level of pollution, middle power density). In essence the invention provides methods and apparatus in which coal is burned simultaneously with natural gas in existing oil boilers or in newly designed coal and gas boilers. The basic concept is to use the attractive features of gas to neutralize some of the repulsive features of coal thereby to achieve the more neutral qualities equivalent or better than that of oil. Specifically the coal-gas burning apparatus and methods will replace residual oil burners, since residual oil is most widely used in steam generation, as well as replacing other types of oil burners.

Successful exploratory tests of burning various mixtures of gas and coal together indicate that gas and coal can be burned together in a variety of arrangements. Among the quantitative considerations favoring a combination of gas and coal to replace oil in oil boilers is the power density consideration. From the dimensions of existing boilers with the same power ratings, it is known, that the normal power densities achieved in typical gas:oil:coal burners vary as about 1.33:1:0.72. This suggests that, gas and coal burning in about equal proportions by energy could be carried out at the normal power density of oil burning.

Residual fuel oil typically yields about 18,000 BTU/lb, whereas coal yields about 14,000 BTU/lb and methane 24,000 BTU/lb. Thus, from a simple energetics standpoint, it would be expected that 60% by weight of coal and 40% by weight of natural gas would lead to the 18,000 BTU/lb of No. 6 fuel oil.

Another simple quantitative consideration, favoring use of gas and coal to replace oil, is based upon the fact that the hydrogen to carbon weight ratio of No. 6 fuel oil is approximately 1 to 9. Granting coal to be predominately Carbon(12) and $CH_4$ to be $4/16=\frac{1}{4}$ hydrogen and $12/16=\frac{3}{4}$ carbon by weight, it should be clear that a burning proportion of 2 carbon atoms to 1 methane molecule, about 60% by weight of coal, and 40% by weight of gas will provide the hydrogen:carbon weight ratio in residual fuel oil.

From the sulfur dioxide pollution standpoint, a mixture of gas and coal can also simulate oil. Take as a representative example, residual fuel oil which releases 1.5 lbs $SO_2$/MBTU (1 MBTU$=10^6$ BTU), which released 2 lbs $SO_2$/MBTU and natural gas which releases negligible $SO_2$. To maintain the oil emission with gas and coal simply requires burning the two fuels in the proportions 25% and 75% (gas to coal). Other examples can be determined as may be required. It should be noted that the $SO_2$ output emission is twice the weight of the sulfur output.

The low ash content of oil (typically 0.1%) is one feature which is not easily replaceable by a mixture of gas (which has no ash) and coal. Thus, it is not possible, with the use of reasonable proportions to reduce the ash production of a gas-coal mixture to the ash production of oil. Furtunately, however, precipitators do capture fly ash in the flue emissions with very high efficiency (99%). Precipitators, however, are expensive and boilers have problems with large quantities of ash. Therefore, when the coal used has a high ash content, it is useful to remove as much ash, as possible before injection into the boilers. Here the invention, as hereinafter described, can be employed for pre-boiler ash removal.

The description provides the main considerations entering the design of three types of gas-coal burners to displace oil burners in boilers. In all the embodiments of the invention, the gas-coal burning mixture is used to simulate the overall power density, energy release/lb and carbon-hydrogen weight ratio of an oil flame, and to approach or decrease the $SO_2$ source density (e.g. lbs of $SO_2$ per million BTU energy release) of the oil burner and boiler.

In addition to the foregoing principles, additional methods and constructional details of improved burning apparatus achieve higher power densities when there is a shortfall in the gas-coal burning power density, with respect to the desired power density or for other purposes. These methods have been suggested in general in many early patents and they include means for imparting, swirling, spiraling, or turbulent motion to fuel-air streams. The prior art U.S. Pat. Nos. 1,947,866-McCourt; 2,335,188-Kennedy; 3,049,085-Musat et al; 3,163,203-Ihlenfield; 3,716,324-Ponthroreau et al; 4,003,692-Moore; and 4,094,625-Wang. The most pertinent of the prior art references are believed to be Zinn (U.S. Pat. No. 3,302,596) and Kennedy (U.S. Pat. No. 2,335,188) neither of which teach or disclose the invention as claimed herein.

A few definitions will be of assistance in understanding the invention herein:

(A) Trochoidal motion refers to curved motion in a plane, such as the curve traced by a point on a circle, which rolls on a straight line or on the inside or outside of another circle. Such motion is useful, for example, to slow down the effective propagation of a flame front when the fuel air mixture is delivered at velocities exceeding the normal flame propagation velocity.

(B) Helical motion or spiral motion, refers to motion in three dimensions, such as that of a point on the thread of a screw as it is twisted into a nut. The path the point travels is like that of a coiled spring. Such motion is useful to increase the time of transit, for example, of a burning particle moving or shot from one side of a burner or boiler towards the opposite side.

(C) Turbulent motion is frequently imparted to fuel and air in burners. This motion may be considered as a random combination of trochoidal and helical motion, and is frequently used in burners to promote good mixing of the fuel with air.

To illustrate the intended objective, consider a representative situation for retrofitting an existing oil boiler to employ the invention. A conversion to coal alone would require a derating of about 60% of the actual oil boiler capacity. With the present principles and techniques for gas-coal burning, it would appear possible by burning gas and coal in 25% to 75% proportions to increase the actual capacity above coal alone by 20%. Higher power levels are achievable by stepping the gas supply upward to 40% of rated capacity while maintaining the coal power at 60%. Such a retrofit would utilize greater reliance upon coal than has been possible in coal-oil mixtures (COM), another proposed approach to the conversion of oil boilers. The best known experience on COM conversion uses coal energy only to the extent of 40% of the mixture. Thus, the COM approach reduces total reliance on residual oil only by 40% but takes on all the undesirable features of a coal conversion, and usually compounds the pollution problems, etc.

The basic principles underlying the design and objectives of gas-coal (oil displaced) burners, the three types of gas-coal burner-boiler systems incorporating these basic principles, as well as other innovations, will be further described hereinafter.

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DESCRIPTION OF THE PREFERRED EMBODIMENTS

Type 1 burners, are intended to utilize coal having a low sulfur content and low ash content, with high fusion temperature. The gas-coal burner injects the mixture directly into the oil burner. Depending upon the original power density used in the design of the boiler, the gas-coal burner utilizes helical or spiral motion to provide enhanced power density. The bottom ash from the burned coal is handled by increasing the size and slope of the bottom ash hopper in a representative oil boiler thereby to collect and dispose of the larger amount of bottom ash associated with gas-coal burning, provided that the ash has a high fusion temperature. The fly ash is collected by precipitators or a bag house.

Both types of ash are disposed of in ash pits, or used as land fill, concrete filler, fertilizer, or road material.

Figure 1:
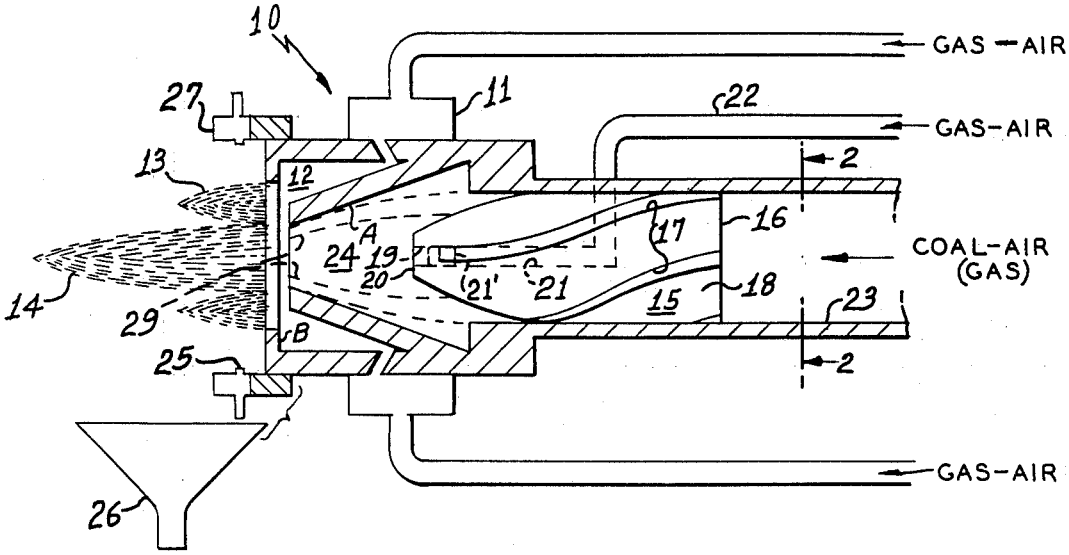
FIG. 1 is a longitudinal cross-sectional view of the improved burning apparatus in accord with one embodiment of the present invention.
Figure 2:
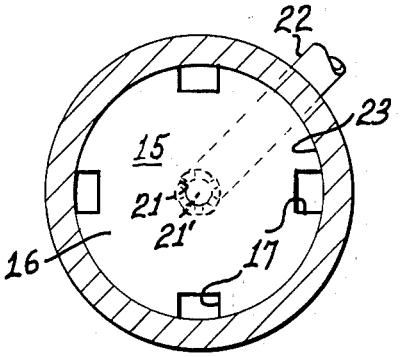
FIG. 2 is an enlarged end view of the burner insert taken along line 2—2 of FIG. 1.

FIG. 1, illustrates a form of Type 1 burner apparatus 10 in accord with the first embodiment of the invention. The apparatus 10 is inserted directly into the boiler chamber (not shown) where the gas-coal burning occurs. The power derived from the gas is intended to range from 10% to 50% of the total power with power from the coal correspondingly providing from 90% to 50%, with the 25%:75% ratio serving as a norm. However, a greater range of mixtures are achievable, an important feature in the event of a shortage of one of the coal or gas fuels. As in the Zinn (U.S. Pat. No. 3,302,596) the gas-air stream from annular manifold 11 is injected into the low-velocity ignition ring chamber 12, such gas-air stream being injected in a trochoidal motion and arranged to provide a flame retention ring 13 around the main flame. This established technique provides a low velocity combustion zone or chamber 12 for stabilizing the main flame 14. As in Zinn, a central nozzle A and at least one concentric annular nozzle B are provided in the burner apparatus 10.

Rather than the coal-air stream being randomly fed into the Zinn (U.S. Pat. No. 3,302,596) burner, the present invention provides a means, in the form of a spirally channeled insert 15 so that the coal-air stream is given a helical motion, to enhance the power density. Any shortfall in the power density achieved simply by burning gas and coal is increased by such helical motion of the coal-air stream. The angularity of helical coal-air motion or trochoidal gas-air motion incorporated into the burner to retrofit an existing oil burner or to design a boiler for gas-coal burning depends upon a number of variables, including the desired proportions of gas and coal power, the types of gas and particularly the coal used, the design power density of the maximum rating of the boiler, and the degree of pollution reduction desired.

The insert 15 includes a solid, or closed lagging end, elongated member 16 having spaced spiral grooves or channels 17 in the outer surface 18 of insert 15. A central orifice or opening 19 is provided in the front leading end 20 of insert 15, and communicating with such opening 19 through passageway 21 is a gas-air source 22 to provide gas-air through opening 19. Thus, when coal-air stream is being channeled through spiral grooves 17 from passageway 23 into the nozzle chamber 24, a central core of a gas-air stream is emitted through opening 19. The additional feature of the gas-coal burner, in accord with this invention, is the provision of such an opening 19 to provide a central core of gas-air for internal burning thereof within the coal-gas ring. Also, igniting and start up of the burner or boiler with gas alone may employ the gas-air stream from opening 19, prior to any feed of the coal-gas as would occur after temperature of the burner or boiler is achieved. Typically this may be at 800° F. When firing the gas-coal mixtures, the apparatus according to this invention causes the helically moving coal-air sheath, illustrated by broken lines 29, generated by the rifled channels 17 to be surrounded inwardly by gas-air flames from the central core due to gas-air being emitted from opening 19 and outwardly by the flame retention ring 13. A source (not shown) of premixed gas and air is provided not only to feed the central passageway 21 and opening 19 as well as the flame retention manifold, but also the coal-air passageway 23. Thus, if coal is in short supply, or when igniting or bringing the burner quickly up to temperature, the entire burner may be operating on gas-air alone. Also, if gas is in short supply, gas-air will be necessary to bring the temperature up to for example 800° F., then coal-air is added until cut off and the boiler is brought up to its normal operating temperature on the order of 2000° F. Of course, when that occurs, the system would be running as a coal only system, with some increased ash and pollution problems, decreased power, etc. The herein disclosed apparatus and method of burning coal in a burning gas-air bath both inwardly and outwardly of the coal-air facilitates combustion of both, the coal and the gas, in the mixed fuel burner shown in FIG. 1. It is also preferred that a channeled plug or insert 21' be located in passageway 21 adjacent opening 19 in the front leading end 20 so that the gas-air mixture within the spirally moving sheath of coal-air mixture 29 also spirals in the same direction to reinforce the vortex or cyclonic motion of the coal-air motion, i.e., a rotating or swirling fireball is provided within the spirally swirling sheath of coal-air mixture to increase the combustion stability, to more completely burn the coal particles, and to further enhance the power density.

Outer spaced orifices 25 in a ring or manifold 27 adjacent the flame, are employed to inject chemical additives in the outer parts of the flame thereby scrubbing the flame and its combustion products. Powdered lime stone or dolomite can be injected through orifices 25 to cause reactions, such as $CaO_2+SO_2 \rightarrow CaSO_4$. Alternately a powdered catalyst, such as bentonite or calcium montmorillinite, can be injected in an outer sheath, as in the Trimex process (U.S. Pat. No. 3,738,819), to enhance the combustion process and to absorb $SO_2$ compounds. Another alternative, in accord with this invention, is to inject into the outer sheath 29 or flames 13 and/or 14 phosphate slimes, which contain good concentrations of bentonite, dolomite, lime, residual phosphates, and minerals. The water in these slimes will be quickly evaporated, at some decrease in energy output, but the dried material containing such minerals will mostly be captured with the bottom ash, which is captured by an appropriate hopper 26, and such bottom ash would have an enhanced economic value as fertilizer.

The gas-coal burner system in accord with the specific embodiment shown and described in FIG. 1 could be employed in most respects like the original oil-burner-boiler system, but with the oil fuel being replaced by gas and coal mainly in the ratio 25%:75% by power. At higher power levels, this ratio would climb to 40%:60%. $SO_2$ control is assisted by, of course, using lower sulfur coal on the order of 1%, by the dilution with natural gas, and by the $SO_2$ scrubbing action, which is accomplished in the burner-boiler system of this invention. In the event of abundant gas supply higher proportions of gas can be used.

Figure 3:
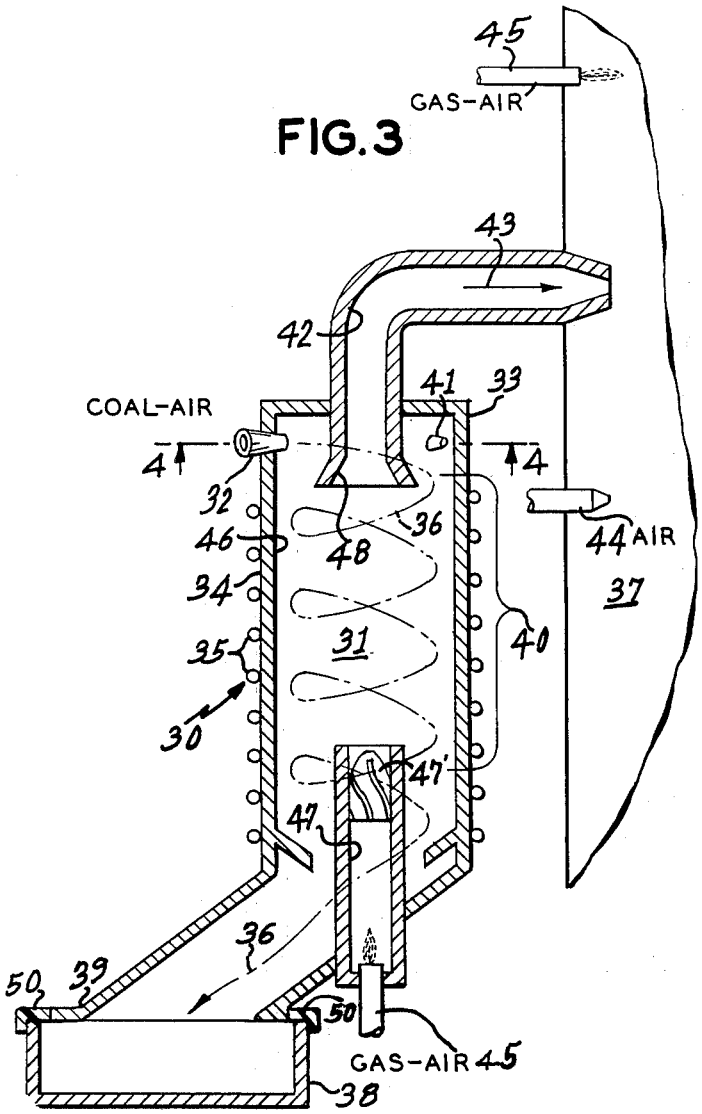
FIG. 3 is a vertical cross-sectional view of the improved burning apparatus in accord with a second embodiment of this invention.
Figure 4:
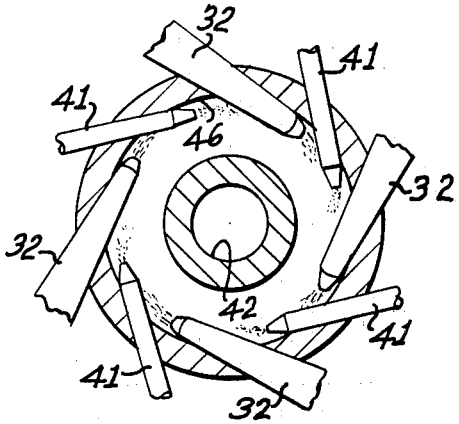
FIG. 4 is an enlarged cross-sectional view taken along line 4—4 of FIG. 3.

In reference to the second embodiment of this invention, a Type 2 gas-coal burner apparatus 20 is depicted in FIGS. 3 and 4. Apparatus 30 is intended to be used with grades of coal which have higher percentages of ash and high fusion temperatures. The gas-coal burner 30 also functions as a pre-combustion or first stage combustion chamber 31 which utilizes a very large degree of helical, spiralling, or cyclonic motion of the fuels. The coal-air fuel is generally tangentially injected through a plurality of spaced injectors 32 into the upper end portion 33 of housing 34, which is suitably insulated by ceramic insulation or the like with cooling water pipe tubes 35 surrounding housing 34, and the coal-air travels in the direction of path 36 which tends to remain adjacent the housing 34. The primary reason for the use of the cyclonic action, in this embodiment, is to achieve a large ash separation before the burning combustion products enter the boiler 37. An attendant benefit therefrom is that larger coal particles, because of the long dwell time in the flame zone 40, causes a savings to accrue on pulverizing equipment. The bottom ash is separated from the combustion fuel rich combustion products by centrifugal forces acting on the heavier ash particles which fall into the conveyor 38 externally of the boiler 37. Gravity also assists in bringing the ash particles to the bottom chute or pit 39 which is removed by conveyor 38. The amount of bottom ash to the total ash collected and disposed by conveyor 38 will be in the range of 60%-90%. The hot combustion fuel rich combustion products and gases are however directed upwardly through and deflected upward into the boiler as illustrated by arrow 43. A suitable seal 50 is provided between the pit 39 and conveyor 38, since there is some pressure within housing 34. In this connection the conveyor 38 may take the form of a compartmented type to insure adequate seal with chute seal 50.

The Type 2 burner apparatus 30 is also designed and fabricated for sulfur removal, which is accomplished by mixing limestone or dolomite, in which coal dust, as by injection through a plurality of spaced injectors 41 which, in the burning zone 40 converts the $SO_2$ to $CaSO_4$, or by spraying materials such as wet bentonite or montmorillenite, which traps sulfur compounds on the bottom ash for later removal. Some of the injected additives preferably may be wet, to control the flame temperature and to foster the production of producer gas, (CO and $H_2$) which enriches the fuel rich combustion gases or products being supplied to the boiler 37 via passageway 42 which communicates at the top of the combustion zone 40. Burning is carried out under fuel rich conditions, which assists in lowering $NO_x$ production. The hot gaseous combustion products including unburned carbon, carbon monoxide, hydrogen, and methane, and higher hydrocarbons are transported via passageway 42 directly into the steam boiler 37, as shown by arrow 43. In the boiler 37, secondary air 44 and added natural gas 45 fosters the second stage combustion needed to achieve the power densities for which the original oil boiler 37 was designed.

As may be seen, the coal-air fuel mixture is injected tangentially into chamber 31 through injectors 32 and the helical path 36 traveled by such mixture causes the coal-air to remain adjacent the inner wall 46 of housing 34. The gas-air mixture is fed through central passageway 47 through the helical hollow sheath of coal-air formed within the housing 34. The gas-air is spiralled or swirled by channeled insert 47' to reinforce the vortex motion of the coal-air mixture. The burning of the gas-air and coal-air mixture is accomplished in the zone 40. The fuel rich combustion products are captured by the funnel end portion 48 which communicates with passageway 42 to supply such fuel rich combustion products into the boiler 37 for the second stage combustion thereof, together with gas-air from 45 and added air 44.

Additionally, it is to be understood that when the temperature of the housing adjacent wall 46 reaches 800° F.-1000° F. the coal-air sheath is ignited outwardly by the radiated heat from inner wall 46 of housing 34 and the gas-air being emitted from inner wall 46 of housing 34 and the gas-air being emitted from passageway 47. It is also important to consider that the gas-air through 47 can be, with some sacrifice to power density, etc., turned off so that only coal-air fuel rich combustion products are provided through passageway 43 into boiler 37. Of course, the temperature of the chamber 31 must be about 1000° F. before one can turn off the gas-air mixture from passageway 47. Due to flue emissions, however, it would appear that gas-air burning through 45 in the boiler to augment the coal burning of the fuel rich combustion products will be needed to bring boiler up to its oil-fired rating and to reduce the $SO_x$ flue emissions.

The gas-coal cyclonic burner pre-combustion chamber 31 provides the needed flexibility for accomplishing secondary and tertiary purposes. Thus this embodiment of the invention permits the direct burning of moist granulated particles of coal having a size which would be delivered by a coal slurry pipeline, for example. The attendant advantages would be to greatly reduce the local cost of retrofitting, since the coal yard, coal conveyors and coal pulverizers would not be necessary on site of the retrofitted boiler. Furthermore, the flexibility, if using coarsely ground lignite, peat, wood, or solid waste with the natural gas proportionally adjusted to maintain the desired power density, is and can be of even greater economic importance due to the lack of dependence on any one fuel, for example, when coal is unavailable because of strikes of workers, etc.

The Type 2 gas-coal burner apparatus 30 also may be used to convert waste phosphate slime into a useable by-product while at the same time accomplishing some $SO_2$ suppression. It is known the bentonite can be used to catalyze the conversion of $SO_2$ to $SO_3$ to $H_2SO_3$ and $H_2SO_4$, which can be captured and brought downward with the bottom ash (Trimex U.S. Pat. Nos. 3,628,925, 3,630,696 and 3,738,819). Many phosphate slimes have a substantial proportion of bentonite and calcium montmorillinite, together with residual phosphates, dolomite, silica, etc. Waste phosphate slimes, after passing through by a pre-cyclone dewaterer, may be injected through injector 41 of the cyclonic gas-coal burner 30. The slime is quickly dried and is transported downward toward the bottom ash conveyor 38, which removes it continuously. This phosphate enriched bottom ash makes valuable fertilizer for tree farms and other non-food forms of agriculture.

Figure 5:
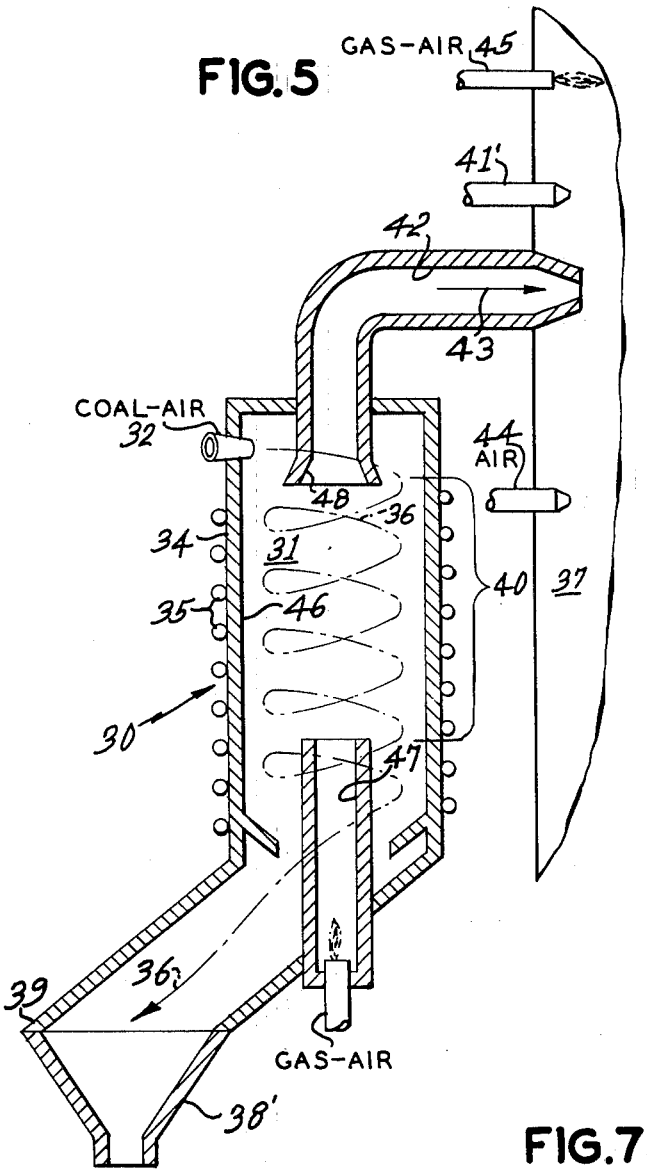
FIG. 5 is a vertical cross-sectional view, substantially the same as FIG. 3, depicting a third embodiment of the present invention.

The Type 3 gas-coal burners in accord with this invention are similar to Type 2, but are intended to be used with coal, which has lower fusion temperatures. Here the gas-coal burner apparatus 30, as seen in FIG. 5, serves as a high temperature pre-combustion chamber 31 and utilizes a very large degree of swirling, spiralling, or cycloning as described in connection with FIG. 3 hereinabove. The coal particle dwell time is increased, so that more complete combustion occurs within the chamber 31. The temperature of the burner is hot enough to melt a large portion of the ash and the molten ash is captured in a slag pit 38', with the fuel rich combustion gases being sent into the boiler 37. The Type 3 burner has some of the characteristics of a small cyclone furnace with the prime exception being that most of the slag is collected outside the boiler 37 herein disclosed. Water or a wet coal slurry may likewise be injected to foster the production of producer gas (CO and $H_2$). Again, burning is carried out under fuel rich conditions to help lower $NO_x$ production. The host gaseous combustion products, including unburned carbon, carbon monoxide, hydrogen and methane and higher hydrocarbons are transmitted via passageway 42 into the steam boiler 37. In the boiler, secondary air 44 and added natural gas-air 45 foster the second stage combustion needed to achieve the power densities for which the original oil boiler was designed.

Only lower melting point additives are introduced into the boiler through injector 41', (it being understood that a plurality of spaced injectors may be used) in the Type 3 burner for pollution suppression, since the molten or wet slag does not lend itself to the production of an ash, which can be used as a fertilizer. Thus, when a higher sulfur content coal is used, a flue gas desulfurization unit or other apparatus or methods would be needed for sulfur dioxide removal.

Figure 6:
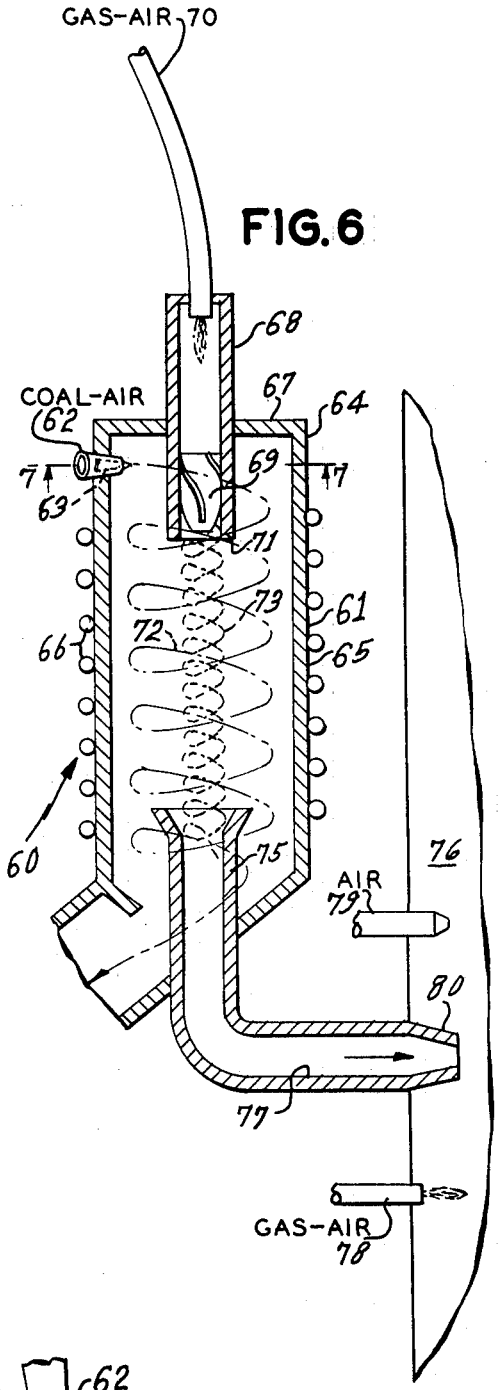
FIG. 6 is a vertical cross-sectional view, similar to FIGS. 3 and 5, and depicting a fourth embodiment of the present invention.
Figure 7:
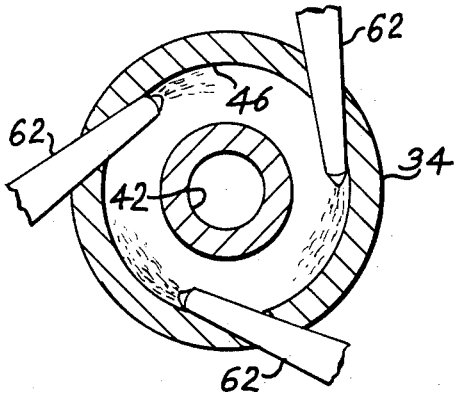
FIG. 7 is an enlarged cross-sectional view taken along line 7—7 of FIG. 6.

In FIGS. 6 and 7, the general arrangement of the parts of this embodiment of the invention are similar to those embodiments of FIGS. 3 and 5. The gas-coal burner apparatus is identified as numeral 60 and includes a pre-combustion or first stage combustion chamber 61 in which the coal-air fuel is tangentially introduced by spaced injectors 62 which may contain rifled plugs or inserts 63 therein, substantially similar to insert 15 of FIG. 1. The coal-air fuel is injected adjacent the upper end portion 64 of housing 65 which is cooled by water pipe or tubes 66 and would be insulated with ceramic insulation or the like. Generally centrally of housing 65 and extending through the upper end plate 67 is an elongated tube 68 in which a spirally channeled insert 69 is located to cause swirling of the gas-air mixture from passageway 70 communicating with insert 69 and tube 68. Thus the gas-air mixture is swirled by insert 69 and such mixture exits from the lower end 71 of the tube 68 generally centrally of the spiral and swirling coal-air path illustrated by numeral 72, the path of the gas-air being illustrated by numeral 73. It is preferred that the swirling paths 72 and 73 of the respective coal-air and gas-air be in the same direction to reinforce the vortex or cyclonic motion of the coal-air mixture to enhance the more complete burning of the coal, in the coal-air mixture, to provide the hot combustion fuel rich combustion products and gases into funneled receiver 75, which is in general in vertical alignment with tube 68, and thence into the boiler 76 via passageway 77. Again, as in FIGS. 3 and 5, larger coal particles may be employed. Gas-air through injector 78 and air through injector 79 would normally be provided adjacent the inlet 80 of the fuel rich combustion products to boiler 76.

If the arrangement of FIG. 6 is to be used as a Type 2 burner, the ash conveyor 38 and interspersed additive injectors 41 into the pre-combustion chamber 31 of FIG. 3 may be employed. If the arrangement of FIG. 6 is to be used as a Type 3 burner, the ash hopper 38' and additive injector 41' into the boiler 37 of FIG. 5 may be employed.

Determination of the velocity of the coal-air mixture and/or gas-air mixture would normally be factors to be considered along with many other design factors. However, the air pressure used to convey the coal particles in the coal-air mixture would be about two atmospheres for the Type 1 burner and several atmospheres in the Type 2 or 3 burners. Sometimes the air pressures of Type 1 may be expected to be about 2 to 4 atmospheres and the Type 2 and 3 to be 2 to 6 atmospheres. Also, the cross-sectional size of the channels in the channeled inserts for coal-air and/or gas-air may be designed to enhance the velocities of the spiral motion of the streams. While each of the channeled streams of coal-air is swirling, the coal particles in such stream are moving along the path of the stream and also are moving randomly within such stream so that greater exposure of the outer layers of the coal particles are exposed to the inner fire ball of the gas-air and/or the outer gas-air of the retention ring of FIG. 1 or the radiant burning of the coal particles from the first stage combustion in FIGS. 3, 5 or 6.

It is to be understood that for even greater enhancement of the burning of the coal in the Type 1 burner, for example, the gas can be mixed with the coal-air to form a coal-air-gas mixture, perhaps with 60% of the total gas therewith, and 30% of the total gas being provided through the central channel within the sheath of coal-air-gas mixture and 10% of the total gas being used in the retention ring. Likewise gas can be added to the coal-air mixture in the Type 2 or 3 burners.

In the Type 2 and 3 burners, the diameter to length ratio of the vortex would depend on many considerations including the important characteristics of the coal. Of course, the coal particles are to be dried, devolatilized, coked and combusted to carbon monoxide by the time the coal particles reach the end of the combustion zone so that only ash particles continue to move toward the deflector into the trough or hopper. As the coal particles descend, their outer layers, which are being burned, contribute fuel rich combustion gases to the central gas vortex which is being fed into the boiler for the second stage combustion.

It is to be noted, that the classifications, Types 1, 2 and 3 gas-coal burners are to be viewed as representative of extremes. In actuality many intermediate types of gas-coal, oil-displaced, burners can be constructed whose detailed structure will depend upon the coal characteristics, e.g. BTU's/lb., organic matter content, sulfur content, ash content, ash composition, ash fusion point, etc. and the detailed features of the oil boiler to be retrofitted, e.g. space availability for pulverizers, ash handling, precipitators, scrubbers, etc.

The essential aspect of each of the burner types is the utilization of the attractive properties of gas to neutralize the repulsive properties of coal, so as to replace oil in an oil fired steam boiler without derating same. The most economic burner-boiler combination, which can accomplish this aspect for a pre-existing oil fired steam boiler is, of course, preferred.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a combustion device for burning a powdered coal-fluid mixture comprising a combustion chamber, first nozzle means communicating with said chamber for spirally swirling said coal-fluid mixture along a path in said chamber to form a hollow sheath of coal-fluid mixture, second nozzle means communicating with said chamber and located generally centrally of said hollow sheath for spirally swirling combustible gas-air mixture in said chamber and within said sheath of coal-fluid mixture in the same direction of swirl to reinforce the swirling motion of said coal-fluid mixture forming said sheath without general mixing therebetween and to promote volatilization and enhance the combustion of said coal-fluid mixture, means for burning said coal-fluid mixture and said gas-air mixture within said chamber, first supply means fluidly communicating with said first nozzle means for providing coal-fluid mixture to said first nozzle means and said chamber, second supply means fluidly communicating with said second nozzle means for providing gas-air mixture to said chamber, said second nozzle means including an elongated insert having upstream and downstream end portions, said downstream end portion of said insert being adjacent said second supply means, a plurality of spaced generally spiral channels in the outer surface of said insert extending from said upstream end portion and terminating in said downstream end portion, said channels communicating between said second supply means and said chamber for spirally swirling said gas-air mixture prior to egressing from said second supply means into said chamber.

2. In a combustion device in accord with claim 1 wherein said coal-fluid mixture is a coal-water slurry.

3. In a combustion device in accord with claim 1 wherein said means for burning said coal fluid mixture is located outwardly of said sheath and includes means for supplying gas-air mixture about said coal-fluid sheath whereby said coal-fluid sheath is more completely combusted.

4. In a combustion device in accord with claim 1 wherein said coal-fluid mixture is a coal-air mixture.

5. In a combustion device in accord with claim 1 wherein said means for burning said coal-fluid mixture is located outwardly of said sheath and includes a chamber into which the coal-fluid mixture is swirled during injection thereof and the path of said coal-fluid mixture is spiraled downwardly so that the coal ash particles may be separated and only fuel rich combustion products from said coal-fluid mixture and gas-air mixture are fed to a boiler or the like.

6. In a combustion device in accord with claim 1 wherein said combustion chamber is elongated and generally disposed vertically, said first and second nozzle means being disposed in the upper portion of said chamber.

7. In a combustion device in accord with claim 1 wherein said combustion chamber is elongated and generally disposed vertically, one said first and second nozzle means being disposed in one of the upper and lower portions of said chamber and the other first and second nozzle means being disposed in the other of said upper and lower portions of said chamber.

8. In a combustion device in accord with claim 1 wherein said first nozzle means includes a first elongated passageway having a longitudinal axis and another elongated insert disposed in said first passageway with its longitudinal axis being substantially aligned with said first passageway longitudinal axis, said second nozzle means including a second elongated passageway having a longitudinal axis, said elongated insert being disposed in said second passageway with its longitudinal axis substantially aligned with said second passageway longitudinal axis.

9. In a combustion device in accord with claim 8 wherein said second passageway and elongated insert are located generally centrally of said other elongated insert and spaced inwardly of said outer surface thereof.

10. In a combustion device in accord with claim 9 wherein said means for burning said coal-fluid mixture is located outwardly of said sheath and includes means for supplying combustible gas-air mixture whereby gas-air is external and internal of said sheath.

11. In a combustion device in accord with claim 1 wherein said device includes a pre-combustion chamber, said first nozzle means injecting said coal-fluid mixture generally tangentially into said chamber to form said hollow sheath, said device further comprising a passageway having an inlet opening communicating with said pre-combustion chamber and an exit opening with a boiler or the like for passing fuel rich combustion products from said chamber into a boiler, said second nozzle means and said inlet opening of said passageway being generally in alignment and said sheath of coal-fluid mixture generally surrounding said second nozzle means and said inlet opening.

12. In a combustion device in accord with claim 11 wherein said first nozzle means includes a plurality of spaced injectors extending into the upper portion of said chamber.

13. In a combustion device in accord with claim 11 further comprising means for injecting chemical additives into said chamber thereby scrubbing the combustion products therein to reduce the $SO_2$ emissions.

14. In a combustion device in accord with claim 11 wherein said first nozzle means is located adjacent the upper portion of said chamber, said second nozzle means being located adjacent the lower portion of said chamber, and said inlet of said passageway being located between said first and second nozzle means.

15. In a combustion device in accord with claim 11 wherein said first nozzle means is located adjacent the upper portion of said chamber, and second nozzle means also being located in said chamber upper portion, said inlet of said passageway being located in the lower portion of said chamber.

16. In a combustion device in accord with claim 1 wherein said combustion chamber is elongated and disposed generally vertically, said first nozzle means being adjacent the upper portion of said chamber for delivering said coal-fluid mixture into said chamber so that the coal ash particles burned from said coal-fluid mixture fall toward the lower portion of said chamber for disposal.

17. In a combustion device in accord with claim 16 further comprising means adjacent said lower portion of said chamber to receive and dispose outwardly of said chamber said coal ash particles.

18. In a combustion device in accord with claim 16 further comprising means communicating with said chamber for passing fuel rich combustion products from said coal-fluid mixture and gas-air mixture outwardly of said chamber and being adapted to be fed to a boiler or the like.

19. In a combustion device in accord with claim 18 wherein said coal-fluid mixture is a coal-air mixture.

20. In a combustion device in accord with claim 18 wherein said coal-fluid mixture is a coal-water slurry.

21. In a combustion device for burning a powdered coal-fluid mixture comprising an elongated generally vertical combustion chamber, first nozzle means communicating with said chamber adjacent the upper portion thereof for substantially tangentially introducing adjacent the inside wall of said chamber a swirling motion to said coal-fluid mixture along a downward path in said chamber to form a hollow sheath of coal-fluid mixture, second nozzle means communicating with said chamber and generally centrally of said hollow sheath for swirling a combustible gas-air mixture within said sheath in the same direction of swirl of said sheath to reinforce the swirling motion thereof and to promote volatilization and enhance the combustion of said coal-fluid mixture, means within said chamber for burning said coal-fluid mixture and said gas-air mixture within said chamber to produce fuel rich combustion products and coal ash particles, means adjacent the lower portion of said chamber to receive and dispose outwardly of said chamber the coal ash particles burned from said coal-fluid mixture, means communicating with said chamber for passing fuel rich combustion products from said coal-fluid mixture and gas-air mixture outwardly of said chamber, the fuel rich combustion products being adapted to be fed to a boiler or the like, said second nozzle means including an elongated insert having upstream and downstream end portions, said downstream end portion of said insert being adjacent a supply of said gas-air mixture, a plurality of spaced generally spiral channels in the outer surface of said insert extending from said upstream end portion and terminating at said downstream end portion, said channels communicating between a supply of said gas-air mixture and said chamber for spirally swirling said gas-air mixture prior to egressing from a supply into said chamber within said hollow sheath of said coal-fluid mixture to reinforce the swirling motion thereto and to promote volatilization and enhance the combustion of said coal-fluid mixture.

22. In a combustion device in accord with claim 21 wherein said coal-fluid mixture is a coal-water slurry.

23. In a combustion device in accord with claim 21 wherein said coal-fluid mixture is a coal-air mixture.

24. In a combustion device for burning a powdered coal-air mixture comprising first nozzle means for spirally swirling said coal-air mixture along a path to form a hollow sheath of coal-air mixture, second nozzle means located generally centrally of said hollow sheath for spirally swirling combustible gas-air mixture within said sheath to enhance the combustion of said coal-air mixture, ignition means outwardly of said sheath to burn said coal-air mixture, said ignition means including an annular ignition ring chamber having an annular opening communicating with said first nozzle means, manifold means fluidly communicating with said ignition ring chamber for providing gas-air mixture to said chamber, said first nozzle means including an elongated insert having upstream and downstream end portions and a concentric annular nozzle therearound, said upstream end portion of said insert being adjacent said concentric annular nozzle, a plurality of spaced generally spiral channels in the outer surface of said insert extending from said upstream end portion and terminating at said downstream end portion, said channels communicating between a supply of said coal-air mixture and said concentric annular nozzle for spirally swirling said coal-air mixture prior to egressing from said supply.

25. In a combustion device for burning a powdered coal-fluid mixture having nozzle means for delivery of said coal-fluid mixture including an elongated converging central nozzle and at least one concentric annular nozzle spaced forwardly of the smaller end of said converging central nozzle, ignition ring means associated with said nozzle means including an annular ignition ring chamber having an annular opening communicating with said nozzle means, manifold means fluidly communicating with said ignition ring chamber for providing combustible gas-air mixture to said chamber, the improvement comprising an elongated insert having upstream and downstream end portions, said downstream end portion being adjacent said central nozzle, a plurality of spaced generally spiral channels in the outer surface of said insert extending from said upstream end portion and terminating at said downstream end portion, said elongated insert being located and said channels communicating between a supply of said coal-fluid mixture and said converging central nozzle for spirally swirling said coal-fluid mixture prior to egressing into said converging central nozzle and from said central nozzle whereby a hollow sheath of said coal-fluid mixture is emitted from said central nozzle into said annular ignition ring chamber, said hollow sheath of said coal-fluid mixture being enveloped by said gas-air mixture from said annular ignition ring chamber without any general mixing between said gas-air mixture and said coal-fluid mixture while promoting volatilization and enhancing the generally complete combustion of said coal-air mixture.

26. In a combustion device in accord with claim 25 further comprising a manifold means adjacent said annular nozzle and having a plurality of spaced orifices for injecting chemical additives into the flame thereby scrubbing the flame and its combustion products.

27. In a combustion device in accord with claim 25 wherein said insert has a predetermined cross-section adjacent said upstream end portion, said insert further including a tapered outer wall from said predetermined cross-section to a lesser cross-section at the most downstream end thereof.

28. In a combustion device in accord with claim 27 further including terminating ends of said channels spacedly of said most downstream end of said insert.

29. In a combustion device in accord with claim 25 wherein said insert includes an outlet disposed in the end of said downstream end portion, a passageway communicating between said outlet and a supply of gas-air mixture for delivering a central core of said gas-air mixture centrally within said hollow sheath of said coal-fluid mixture to enhance the combustion thereof in said annular ignition chamber.

30. In a combustion device in accord with claim 29 further comprising a manifold means adjacent said annular nozzle for injecting chemical additives into the flame thereby scrubbing said flame and its combustion products.

31. In a combustion device in accord with claim 30 further comprising a plug having a plurality of spaced and spiral channels in the outer surface thereof and positioned in said passageway whereby said gas-air mixture being injected centrally of said hollow sheath is spirally swirling.

32. In the combustion device in accord with claim 31 wherein said spirally swirling gas-air mixture reinforces the motion of said spirally swirling sheath of coal-fluid mixture.

33. In a combustion device in accord with claim 25 further comprising means for delivering a central core of said gas-air mixture centrally within said hollow sheath of said coal-fluid mixture without any general mixing between said gas-air mixture and said coal-fluid mixture to more completely combust said coal-fluid mixture.

34. In a combustion device in accord with claim 33 further comprising a plug having a plurality of spaced and spiral channels in the outer surface thereof and positioned between a supply of gas-air mixture and said convering central nozzle whereby said gas-air mixture being injected centrally of said hollow sheath is spirally swirling.

35. In a combustion device in accord with claim 34 wherein said channels of said insert and plug are directed in a predetermined direction whereby said spirally swirling gas-air mixture reinforces the motion of said spirally swirling sheath of coal-fluid mixture.

36. In a combustion device in accord with claim 33 further comprising a manifold adjacent said annular nozzle for injecting chemical additives into the flame thereby scrubbing the flame and its combustion products.

37. In a combustion device in accord with claim 36 further comprising a plug having a plurality of spaced and spiral channels in the outer surface thereof and positioned between a supply of gas-air mixture and said converging central nozzle whereby said gas-air mixture being injected centrally of said hollow sheath is spirally swirling.

38. In a combustion device in accord with claim 37 wherein said channels of said insert and plug are directed in a predetermined direction whereby said spirally swirling gas-air mixture reinforces the motion of said spirally swirling sheath of coal-fluid mixture.

39. In a combustion device in accord with claim 25 further comprising a plug having a plurality of spaced and spiral channels in the outer surface thereof and positioned between a supply of gas-air mixture and said converging central nozzle, whereby said gas-air mixture being injected centrally of said hollow sheath is spirally swirling.

40. In a combustion device in accord with claim 39 wherein said channels of said insert and plug are directed in a predetermined direction whereby said spirally swirling gas-air mixture reinforces the motion of said spirally swirling sheath of coal-fluid mixture.

41. In a combustion device for burning a powdered coal-air mixture comprising a combustion chamber, first nozzle means for spirally swirling said coal-air mixture along a path in said chamber to form a hollow sheath of coal-air mixture, second nozzle means located generally centrally of said hollow sheath for spirally swirling combustible gas-air mixture in said chamber and within said sheath in the same direction of swirl to reinforce the swirling motion of said sheath and to promote volatilization and enhance the combustion of said coal-air mixture, ignition means for burning said coal-air mixture and said gas-air mixture within said chamber, supply means fluidly communicating with said first nozzle means for providing coal-air mixture to said chamber, manifold means fluidly communicating with said second nozzle means for providing said gas-air mixture to said chamber, said first nozzle means including an elongated insert having upstream and downstream end portions, said downstream end portion of said insert being adjacent said supply means, a plurality of spaced generally spiral channels in the outer surface of said insert extending from said upstream end portion and terminating in said downstream end portion, said channels communicating between said supply and said chamber for spirally swirling said coal-air mixture prior to egressing from said supply means into said chamber.

* * * * *